US010011107B2

(12) United States Patent
Theumert

(10) Patent No.: US 10,011,107 B2
(45) Date of Patent: Jul. 3, 2018

(54) METHOD FOR PRINTING FILM BAGS

(71) Applicant: Henkel AG & Co. KGaA, Duesseldorf (DE)

(72) Inventor: Gerhard Josef Theumert, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 14/737,044

(22) Filed: Jun. 11, 2015

(65) Prior Publication Data

US 2015/0273815 A1 Oct. 1, 2015

Related U.S. Application Data

(63) Continuation of application No. PCT/EP2013/063121, filed on Jun. 24, 2013.

(30) Foreign Application Priority Data

Dec. 14, 2012 (DE) ..... 10 2012 223 154

(51) Int. Cl.

| | |
|---|---|
| ***B41F 17/00*** | (2006.01) |
| ***B65B 61/26*** | (2006.01) |
| *B41M 1/30* | (2006.01) |
| *B41M 1/40* | (2006.01) |

(52) U.S. Cl.
CPC ..... *B41F 17/001* (2013.01); *B65B 61/26* (2013.01); *B41M 1/30* (2013.01); *B41M 1/40* (2013.01)

(58) Field of Classification Search
CPC ..... B65B 61/26; B41F 17/001; B41F 17/006; B41M 1/30; B41M 1/40
See application file for complete search history.

(56) References Cited

U.S. PATENT DOCUMENTS

| | | | | |
|---|---|---|---|---|
| 3,916,784 | A * | 11/1975 | Dubuit | B41F 17/001 101/151 |
| 5,666,785 | A * | 9/1997 | Jouffreau | B41M 1/30 53/411 |
| 5,943,957 | A * | 8/1999 | Mason | B41F 17/001 101/170 |
| 6,787,512 | B1 | 9/2004 | Verrall et al. | |
| 2009/0120316 | A1 * | 5/2009 | Denome | B41M 1/30 101/483 |

FOREIGN PATENT DOCUMENTS

| | | | |
|---|---|---|---|
| DE | 202010011606 | U1 | 12/2010 |
| WO | 2007/034471 | A2 | 3/2007 |
| WO | 2008/004199 | A2 | 1/2008 |
| WO | 2009/063355 | A1 | 5/2009 |
| WO | 2010/135238 | A1 | 11/2010 |

OTHER PUBLICATIONS

PCT International Search Report (PCT/EP2013/063121) dated Nov. 9, 2013.
Taniyasales, "Pouch Pneumetic Pad Printing Machine.mpg", XP054975207, Feb. 8, 2012, retrieved from the internet, URL: https://www.youtube.com/watch?feature=player_detailpage &v=mvGsuu_SZbs.

* cited by examiner

*Primary Examiner* — Blake A Tankersley
(74) *Attorney, Agent, or Firm* — Thomas G. Krivulka

(57) ABSTRACT

The present invention relates to a method for printing a bag with a print, which bag is filled with a detergent or cleaning agent and is made from a water-soluble or water-dispersible film, wherein the printing of the bag is carried out by means of an inking-pad printing process; and to a method for producing film bags of this type; and to the film bags which are produced in this way.

7 Claims, 2 Drawing Sheets

METHOD FOR PRINTING FILM BAGS

FIELD OF THE INVENTION

The present invention generally relates to a method for printing water-soluble or water-dispersible film bags containing a detergent or cleaning agent.

BACKGROUND OF THE INVENTION

Detergents and cleaning agents, such as dishwashing detergents, are available to the consumer in a large number of forms. Besides the traditional solid agents, flowable and in particular liquid to gel-like agents have gained increasingly in significance in recent years. The consumer appreciates in particular the rapid solubility and the associated rapid availability of the constituents in the washing and cleaning liquor, in particular also in short washing and dishwashing programs and at low temperatures.

Furthermore, consumers have become used to a comfortable dosing of pre-portioned detergents and dishwasher detergents. In order to bring a liquid detergent or dishwashing detergent that offers the above-mentioned advantages compared with solid compositions into a pre-portioned form, the use of cold-water-soluble films in the form of bags is conventional. The detergent or cleaning agent in this case may be produced in such a way that individual portions are each packaged separately.

The water-soluble wrapping is normally formed from a water-soluble or water-dispersible film material, in particular consisting of polymers or polymer mixtures. The wrapping can consist of one or of two or more layers of water-soluble or water-dispersible film material. By way of example, films are often used that can be glued and/or sealed to form packagings such as tubes or pillows, once they have been filled with an agent.

In many products the water-soluble or water-dispersible wrapping contains polyvinyl alcohol or a polyvinyl alcohol copolymer, since wrappings of this type have good stability with sufficiently high water solubility, in particular cold water solubility.

Liquid detergents and cleaning agents are currently offered in water-soluble film bags, the individual film bags, which contain individual portions, being offered in an outer packaging that contains a plurality of film bags. Whereas the outer packaging discloses instructions with regard to use and hazardous substances, as well as product name, manufacturer, etc., an individual film bag does not provide the user with this information. It is known to print the water-soluble film of such a film bag prior to forming (thermoforming; deep-drawing), as described for example in international patent publications WO 2010/135238 A1 and WO 2009/063355 A1 and also U.S. patent specification U.S. Pat. No. 5,666,785 A1. The final print image, however, can only be influenced with difficulty due to the subsequent deep-drawing and is often distorted or spoilt. A further possibility is the use of labels, which can be adhered to the film bag, however this is associated with additional costs and complex production techniques.

The object of the present invention was therefore to provide an improved possibility for presenting information on water-soluble or water-dispersible film bags containing detergents or cleaning agents.

This object is achieved in accordance with the present invention in that the filled, finished film bags are printed in an inking-pad printing process. In a first aspect the invention therefore relates to a method for printing a bag with a print, which bag is filled with a detergent or cleaning agent and is made from a water-soluble or water-dispersible film, characterized in that the printing of the bag is carried out by means of an inking-pad printing process.

In a further aspect the invention is directed to the printed bags produced by means of the method according to the invention, which bags are filled with a detergent or cleaning agent and made from a water-soluble or water-dispersible film.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A method for printing a bag with a print, which bag is filled with a detergent or cleaning agent and is made from a water-soluble or water-dispersible film, characterized in that the printing of the bag is carried out by means of an inking-pad printing process.

A method for producing a bag with a print, which bag is filled with a detergent or cleaning agent and is made from a water-soluble or water-dispersible film, characterized in that the method comprises the steps of: forming at least one cavity in a first water-soluble or water-dispersible film web, filling the at least one cavity with the detergent or cleaning agent, closing the cavity using a second water-soluble or water-dispersible film web, and at least partially printing the outer surface of the bag with an ink or a medium containing the color-imparting substance by means of an inking-pad printing process.

BRIEF DESCRIPTION OF THE DRAWINGS

The present invention described herein can be more readily understood with reference to the appended drawing figures where.

DETAILED DESCRIPTION OF THE INVENTION

Figure 1:
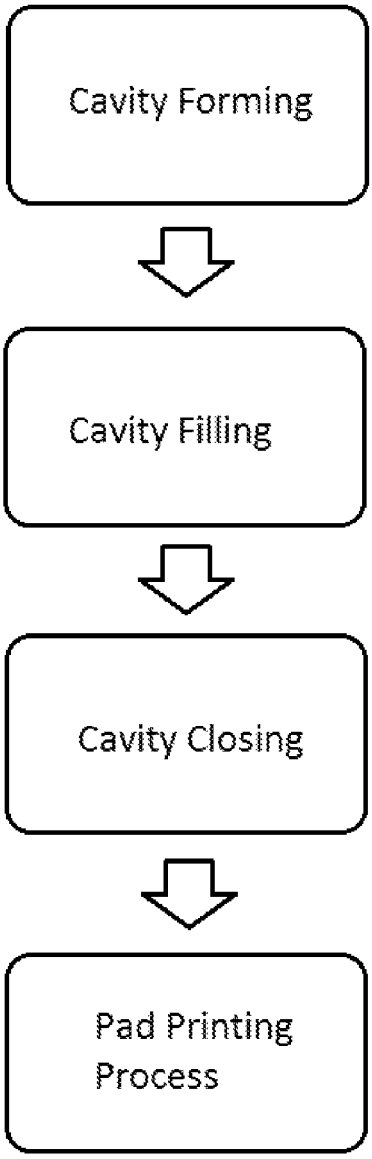
FIG. 1 is a flow chart of the overall process described herein.
Figure 2:
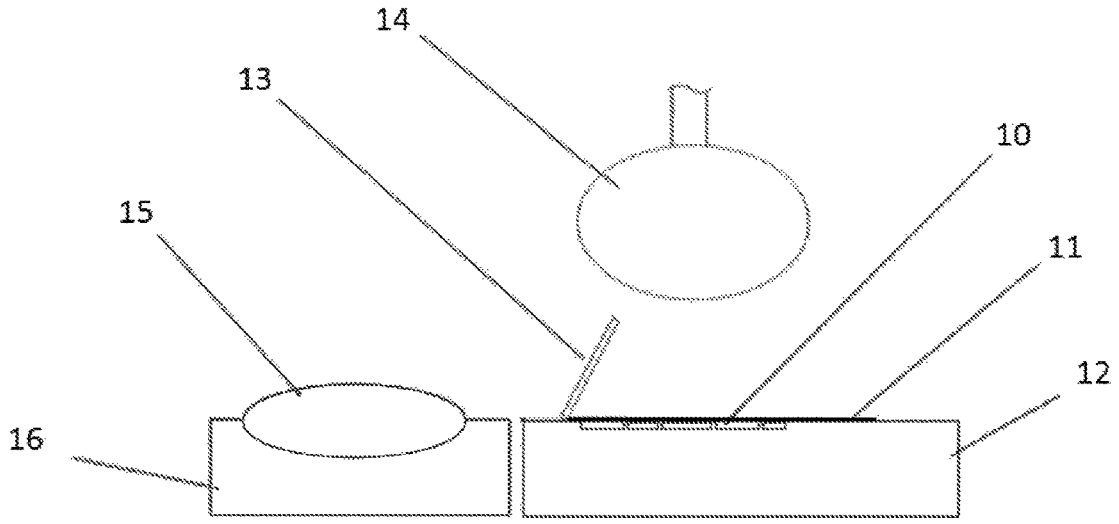
FIG. 2 is a schematic showing the elements of pad printing for producing a bag with a print.

The following detailed description of the invention is merely exemplary in nature and is not intended to limit the invention or the application and uses of the invention. Furthermore, there is no intention to be bound by any theory presented in the preceding background of the invention or the following detailed description of the invention.

Inking-pad printing processes are known in the prior art. Inking-pad printing is an indirect gravure printing process, in which the printing ink is transferred by a resilient inking pad, usually made from silicone rubber, from the printing plate to the printing substrate. In the case of this printing process, the print image that is to be transferred is normally exposed using a positive film (offset film) onto a cliché. This cliché is then washed out, the exposed print image remaining on the surface of the cliché in a recessed manner. The cliché may consist of a wide range of materials, and a distinction is thus made for example between steel cliché s and plastic cliché s. Alternatively, the cliché may also consist of zinc or copper.

During the printing process the printing ink is normally spread over the cliché using a doctor blade made of metal or plastic and removed using the doctor blade or a knife, the color remaining in the depression. The inking pad is then placed on this printing plate, lifted again in a manner entraining printing ink, and moved to the printing substrate. There, the inking pad is lowered, adapts to the shape, and leaves behind the ink (the print image) on the item to be printed. Since the inking pad itself is resiliently deformable and can assume the shape of the body to be printed, the printing of (convexly, concavely or irregularly) curved surfaces is possible with this method without distorting or spoiling the print image. Depending on the material of the inking pad or the type of ink, the ink transfer onto the printing substrate is up to 100%.

In various embodiments of the invention the inking pad that is used to print the film bags has a hardness that is selected such that it adapts to the shape of the bag and good contact is produced between inking pad surface and bag surface without damaging the bag. The inking pad may thus preferably have a Shore A hardness in the range of 0-20, preferably 0-15, in particular of approximately 5. In various embodiments the inking pad consists of silicone rubber and is resilient.

The method according to the invention comprises, in various embodiments of the invention, the following steps:

(i) applying an ink (10) or a medium containing a color-imparting substance to a cliché (12);

(ii) removing excess ink (11) or excess medium by means of a doctor blade (13);

(iii) pressing the inking pad (14) onto the cliché (12), wherein the ink (10) or the medium is transferred from the cliché (12) to the inking pad (14); and (iv) pressing the inking pad onto the bag (15), wherein the ink or the medium is transferred from the inking pad to the bag.

In certain embodiments of the method, steps (i) to (iv) can be repeated a number of times, preferably 1 to 3 times. Here, other inks or media containing a color-imparting substance are preferably used, such that multi-colored prints are also possible. The repetitions of steps (i) to (iv) can be each carried out in separate printing units, which can be arranged in succession in a continuous method.

The inking-pad printing process can be carried out continuously and can be any known form of the inking-pad printing process, for example a rotary inking-pad printing process.

In the method according to the invention the bag can be fixed in a holder (16) so as to avoid a shifting during the printing process. Here, the holder may have a shape that is matched to the shape of the film bag. By way of example the holder may have a concave depression that corresponds to the convex surface of the bag. By way of example the lower part of the mold already used for forming (thermoforming; deep-drawing) and/or filling the bag can also be used as such a holder.

The bag consists of a water-soluble or water-dispersible wrapping, which forms a closed structure, which in the interior thereof has one or more chambers for receiving one or more agents. The water-soluble or water-dispersible wrapping is formed by a water-soluble or water-dispersible film material.

The bag can have any shape, wherein the shape is largely adapted to the conditions of use, but is normally tubular, pillow-shaped, cylindrical, bottle-shaped or disk-shaped. The film bag may in various embodiments have a length from 20 to 50 mm, a width from 15 to 50 mm, and a height from 10 to 50 mm. The bags usually consist of two film pieces placed one on the other and glued/welded to one another at the edge, and therefore have a cavity wrapped by film and filled with the agent, and also a peripheral edge. If the basic shape of the film pieces is rectangular, a pillow shape can thus be produced, and if the basic shape is round, a disk shape can thus be produced. Alternatively, the film bag may also consist of a single film web that is rolled and glued/welded to itself, whereby tubular and cylinder shapes can also be produced.

In various embodiments the bag has two opposite approximately convex surfaces, which can be printed. It is preferable that the film bag has no folds in the printing area. This can be achieved for example in that the bag, following production, has an internal pressure that is higher than the external pressure. In various embodiments of the invention one surface is printed, and in other embodiments both surfaces are printed. Here, the motif can be the same or different.

The printed print image is generally in no way limited, but is normally constituted by letters, numbers, symbols, decorations or the like, in particular lettering and/or graphic patterns. Specific examples are trademarks or product names and also manufacturer logos, instructions for use, safety information, etc. The motif can be single-colored or multi-colored, wherein, in the case of multi-colored motifs, different colored inks can be printed in a number of steps (for example four-color printing). The size and placement of the print image is preferably selected such that a complete print image can be printed onto each film bag.

The film used to produce the film bag may have a predefined area, onto which the print is printed by means of the method according to the invention. This predefined area may be colored in various embodiments, or may be colored differently from the rest of the film. By way of example, an area printed white is conceivable. The area may also be covered or printed with a layer that separates the printed ink from the underlying water-soluble film. This layer, for example, may be a protective layer as described below.

The printing inks or colored inks used for printing are selected such that they are compatible with the material of the film bag, i.e. in particular neither dissolve said material nor otherwise react therewith and compromise the structural integrity thereof. It is also preferable that the colored inks are water-soluble and preferably dissolve in water in a residue-free manner. Furthermore, upon use of the detergent or cleaning agent, they should not cause any residues or discolorations on the items to be washed or cleaned. The printing inks/colored inks may have any suitable viscosity that enables printing in the inking-pad printing process. Suitable inks are obtainable for example under the trade name SunChemical Aquadestruct (Sun Chemical, NJ, USA), Aqua Poly Super Opaque White QW000046 from the company Environmental Inks, or Opta Film OPQ White W0L009656 from the company Water Ink Technologies Inc.

The expressions "water-soluble" and "water-dispersible", as used herein, relate to the property of the film to dissolve or to decompose upon contact with water and to release the content of the film bag. It is preferable that the components of the film can dissolve or disperse in water in a residue-free manner where possible. In various embodiments "water-soluble" means that the corresponding film dissolves within 90 seconds in water with a temperature of 20° C. or less. Corresponding test methods are described for example in U.S. Pat. No. 6,787,512 B1.

Suitable water-soluble or water-dispersible films for producing the film bag are preferably based on a polymer or polymer mixture, in particular polyvinyl alcohol or a polyvinyl alcohol copolymer. Further suitable polymers include, but are not limited to, polyvinylpyrrolidone, polyalkylene oxide, acrylamide, acrylic acid, cellulose, cellulose ether, cellulose ester, cellulose amides, polyvinyl acetates, polycarboxylic acids and the salts thereof, polyamino acids or peptides, polyamides, polyacrylamide, copolymers of maleic acid and acrylic acid, polysaccharides, including starch and gelatin, and natural rubbers, such as xanthan gum and carrageenan. Preferred polymers are selected from polyacrylates and water-soluble acrylate copolymers, methyl cellulose, carboxymethyl cellulose, dextrin, ethyl cellulose, hydroxyethyl cellulose, hydroxypropyl methylcellulose, maltodextrin, polymethacrylates, and particularly preferably from polyvinyl alcohols (PVA), polyvinyl alcohol copolymers and hydroxypropylmethyl cellulose (HPMC) and combinations thereof. The bag can be formed from one or two or more layers of the water-soluble or water-dispersible film material. The water-soluble or water-dispersible film material of the first layer and the further layers, if provided, can be the same or different. Films that for example can be glued and/or sealed to form packagings, such as tubes or pillows, once they have been filled with an agent are particularly preferred.

The quantity of polymer in the water-soluble or water-dispersible film, for example PVA, is normally at least 60% by weight. The molecular weight of the polymers, in particular of PVA or polyvinyl alcohol copolymers, may preferably lie in the range from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

Polyvinyl alcohol is normally produced by hydrolysis of polyvinyl acetate, since the direct synthesis path is not possible. The same is true for polyvinyl alcohol copolymers, which are produced accordingly from polyvinyl acetate copolymers. It is preferred when at least one layer of the water-soluble or water-dispersible wrapping comprises a polyvinyl alcohol of which the degree of hydrolysis accounts for 70 to 100 mol %, preferably 80 to 90 mol %, particularly preferably 81 to 89 mol %, and in particular 82 to 88 mol %.

A polymer selected from the group comprising (meth) acrylic acid-containing (co)polymers, polyacrylamides, oxazoline polymers, polystyrene sulfonates, polyurethanes, polyesters, polyethers, polylactic acid or mixtures of the above polymers may additionally be added to a polyvinyl alcohol-containing film material suitable for producing the water-soluble or water-dispersible wrapping. Polylactic acids constitute a preferred additional polymer.

Besides vinyl alcohol, preferred polyvinyl alcohol copolymers also comprise dicarboxylic acids as further monomers. Suitable dicarboxylic acids are itaconic acid, malonic acid, succinic acid and mixtures thereof, wherein itaconic acid is preferred.

Besides vinyl alcohol, polyvinyl alcohol copolymers that are likewise preferred also comprise an ethylenically unsaturated carboxylic acid, the salt thereof or the ester thereof. Besides vinyl alcohol, such polyvinyl alcohol copolymers particularly preferably contain acrylic acid, methacrylic acid, acrylic acid ester, methacrylic acid ester or mixtures thereof.

It may be preferred for the film material to contain further additives. The film material for example may contain plasticizers, such as dipropylene glycol, ethylene glycol, diethylene glycol, propylene glycol, glycerol, sorbitol, mannitol or mixtures thereof. Further additives for example include release aids, fillers, cross-linking agents, surfactants, antioxidants, UV absorbers, anti-blocking agents, anti-adhesives, or mixtures thereof.

Suitable water-soluble or water-dispersible films for use in the water-soluble or water-dispersible wrappings of the water-soluble or water-dispersible packagings according to the invention are films that are marketed by the company MonoSol LLC, for example under the name M8630, C8400 or M8900. Other suitable films include films with the name Solublon® PT, Solublon® GA, Solublon® KC or Solublon® KL from Aicello Chemical Europe GmbH or the films VF-HP from Kuraray.

The film bags are normally produced by deep-drawing (thermoforming), i.e. the heating and forming of thermoplastics, in the present case of the water-soluble or water-dispersible film. In these processes the film is heated and brought into the desired shape. These shaping processes include a step of filling the pre-formed film bag and also a further step in order to then close the filled film bag.

In general, there exist a plurality of possibilities for producing the water-soluble or water-dispersible film bags. Besides the vertical form-fill-seal method, the use of a horizontal form-fill-seal method is also possible in particular.

The production of a water-soluble or water-dispersible film bag can comprise the following steps:

a) forming at least one cavity in a first water-soluble or water-dispersible film web,
b) filling the at least one cavity with an agent, and
c) closing the cavity using a second water-soluble or water-dispersible film web.

This method can be provided before the printing process according to the invention, such that, in one embodiment of the printing process according to the invention, the steps for producing a water-soluble or water-dispersible packaging are included. In such a method, step c) is followed by a further method step d), which comprises the least partial printing of the outer surface of the water-soluble or water-dispersible wrapping with an ink or another medium containing a color-imparting substance. Step d) can be repeated any number of times, such that a plurality of identically or differently printed areas are produced on the outer surface of the water-soluble or water-dispersible wrapping. Here, step d) may be the inking-pad printing process of the invention.

In various embodiments of the method a plurality of film bags can be printed simultaneously. To this end, the film bags can be produced for example in such a way that two or more film bags are still interconnected after the filling and closing and these are printed simultaneously and are only optionally separated from one another following the printing. In such a method for producing and printing film bags, a plurality of cavities are formed in the first film web and filled with an agent, and then the corresponding cavities are closed using a second film web. To this end, the two film webs can be welded around the respective cavities, such that a plurality of bags are interconnected via the welded edges. If desired, these can then be separated in a further step, for example by cutting, such that individual film bags or a defined number of interconnected film bags is obtained.

The printing of a larger number of interconnected film bags has the advantage that the placement, and register in the case of multi-color printing, is simplified.

Accordingly, a further subject matter of the invention is a method for producing a bag with a print, which bag is filled with a detergent or cleaning agent and is made from a water-soluble or water-dispersible film, said method comprising the steps of:

a) forming at least one cavity in a first water-soluble or water-dispersible film web,
b) filling the at least one cavity with a product,
c) closing the cavity using a second water-soluble or water-dispersible film web, and
d) at least partially printing the outer surface of the water-soluble or water-dispersible film with an ink or a medium containing the color-imparting substance by means of an inking-pad printing process.

In various embodiments the printing step d) is carried out as described above in conjunction with the printing process according to the invention. In particular, all embodiments of the printing process disclosed as preferable herein in this context can also be transferred to the printing step of the production method. The film surface is preferably printed in the area of the film that covers or wraps the cavity. As used herein, "at least one" relates to 1 or more, preferably at least 2, 3, 4, 5, 10, 15, 20 or more.

As already described above, a plurality of cavities can be formed in a first film web and filled and closed using a second film web in various embodiments of the method, wherein the printing then takes place prior to a cutting out of the film bag from a doubled film web that contains a plurality of closed cavities and is preferably partially welded.

In one embodiment of the method at least two cavities are therefore formed, filled and closed, and in step d) areas of the respective surfaces of the film forming the cavities, in particular the convex surfaces of the cavities, are printed simultaneously. After the printing step, a step of forming the individual film bags or a plurality of interconnected film bags may optionally follow, for example a step for cutting out the film bags from the glued/welded film web.

The used films (film webs) can be free from color-imparting substances, but may also contain one or more color-imparting substances. The printing with the color-imparting substance can be implemented here on colored and/or uncolored areas of the wrapping colored at least partially with a color-imparting substance.

In all embodiments of the method for producing a water-soluble or water-dispersible film bag, the first water-soluble or water-dispersible film is printed with the color-imparting substance following the formation and the closure of the cavity filled with the agent.

One advantage of the printing following the production of the film bags is that the printing is individualized, that is to say can be provided in accordance with the requirements/conditions, for example in view of the shape and content, of the respective currently produced water-soluble or water-dispersible packaging. When using previously printed films, the film web on the one hand must be replaced in the event of changes to the composition of the water-soluble or water-dispersible packaging, and the production method must be interrupted, and on the other hand it must be ensured by means of continuous printing of the previously printed film web that the water-soluble or water-dispersible wrapping is colored at least in part. Here, a selective positioning of the coloring is not possible, by contrast with the present invention.

The printing process can be followed optionally by a drying process, in which the solvent contained in the ink or in the medium containing the color-imparting substance is evaporated/removed by blowing gas, of which the temperature is controlled, onto or over the printed film, by passing said film through a drying oven, or by irradiation with infrared light. Alternatively, the printing process can be followed by a curing process using UV light.

In addition, it may be advantageous when printing the outer surface of the water-soluble or water-dispersible film wrapping to apply a water-soluble or water-dispersible protective varnish to the printed areas of the water-soluble or water-dispersible wrapping in order to prevent the coloration from being smudged and/or from disappearing as a result of atmospheric moisture and/or mechanical load, such as friction. This is preferably also printed on by means of an inking-pad printing process. This protective varnish layer is preferably clear and contains no color particles. Materials that are suitable accordingly are known in the prior art.

The detergent or cleaning agent contained in the film bags can be solid, in particular in powder form, or liquid, but is preferably liquid. Here, the term "liquid" also includes gel-like or pasty agents, with or without yield point. The cleaning agents are preferably dishwasher detergents. Generally, all suitable detergents or cleaning agents can be contained in the film bags, but the detergents or cleaning agents preferably contain little water to no water in order to avoid a premature dissolution of the film wrapping.

In one embodiment the film bag has a chamber for receiving the agent. The agent in this embodiment may preferably comprise a powder, a granulate, a gel or a liquid. In a further embodiment the film bag has two chambers. In this embodiment the first chamber preferably contains a liquid agent and the second chamber preferably contains a solid or a liquid agent. Alternatively, both chambers may contain a solid agent. If the film bag has three chambers, these may all contain a liquid or a solid agent. However, it is also possible that one chamber contains a solid agent and two chambers contain a liquid agent. In addition it is possible that a solid agent is contained in two chambers and a liquid agent is contained in one chamber.

In the case of water-soluble or water-dispersible packagings having four or more chambers, there are accordingly even more possible combinations in view of the number of chambers containing a solid or a liquid agent.

The agents that are contained in the different chambers of a water-soluble or water-dispersible film bag may have the same composition. The agents in a water-soluble or water-dispersible film bag having at least two chambers preferably have compositions that differ at least in one constituent or at least in the content of one constituent.

The agent contains constituents that do not destroy the structural integrity of the water-soluble or water-dispersible wrapping. If the used agent is a liquid or solid detergent or cleaning agent, it may contain one or more substances from the group of surfactants, builders, bleaching agents, bleach activators, bleach catalysts, enzymes, enzyme stabilizers, electrolytes, pH adjusters, perfumes, perfume carriers, fluorescence agents, dyes, hydrotopes, foam inhibitors, silicone oils, anti-redeposition agents, greying inhibitors, anti-shrink agents, anti-crease agents, color transfer inhibitors, antimicrobial active ingredients, non-aqueous solvents, germicides, fungicides, antioxidants, preservatives, corrosion inhibitors, antistatic agents, bitters, ironing aids, repellants and impregnating agents, opacifiers, skincare active ingredients, swelling and antislip agents, softening components, fillers and also UV absorbers.

As already mentioned above, the liquid detergents or cleaning agents may contain little or no water.

The expression "containing little water" as used herein means that the composition characterized in this way contains less than 25% by weight water, preferably less than 20% by weight water. In particular, compositions that contain 1 to 20% by weight water, 1 to 15% by weight water, 5-15% by weight water or 10 to less than 20% by weight water are included by this term.

As used herein, "containing no water" means that a composition contains less than 5% by weight, in particular less than 3% by weight, preferably less than 1% by weight water.

The water content as defined herein relates to the water content determined by means of Karl Fischer titration.

In all embodiments with two films or webs, a plurality of films can be used above one another, for example in order to reinforce the pouch, or to form chambers arranged above one another. Such embodiments with chambers arranged above one another are known from the prior art.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for producing a bag with a print, which bag is filled with a detergent or cleaning agent and is made from a water-soluble or water-dispersible film, characterized in that the method comprises the steps of:

(i) forming at least two cavities in a first water-soluble or water-dispersible film web, (ii) filling the at least-two cavities with the detergent or cleaning agent, (iii) closing the cavities using a second water-soluble or water-dispersible film web, and (iv) at least partially printing the outer surface of the bag, fixed in a holder, with an ink or a medium containing a color-imparting substance by means of an inking-pad printing process having an inking pad, wherein the inking pad has a Shore A hardness in the range of 0-20;

wherein the steps are carried out in succession in a continuous process.

2. The method as claimed in claim 1, characterized in that the inking pad consists of resilient silicone rubber.

3. The method as claimed in claim 1, characterized in that the inking-pad process comprises the steps of:

(i) applying an ink or a medium containing a color-imparting substance to a cliché;

(ii) removing excess ink or excess medium by means of a doctor blade;

(iii) pressing the inking pad onto the cliché, wherein the ink or the medium is transferred from the cliché to the inking pad; and (iv) pressing the inking pad onto the bag, wherein the ink or the medium is transferred from the inking pad to the bag.

4. The method as claimed in claim 3, characterized in that steps (i) to (iv) are repeated a number of times with different inks or medium.

5. The method as claimed in claim 1, characterized in that the holder is the lower part of the mold already used to form and/or fill the bag.

6. The method as claimed in claim 1, characterized in that the ink or medium is water-soluble.

7. The method as claimed in claim 1, characterized in that the water-soluble or water-dispersible film contains polyvinyl alcohol or a polyvinyl alcohol copolymer.

* * * * *